US006731186B2

(12) United States Patent
Okada et al.

(10) Patent No.: US 6,731,186 B2
(45) Date of Patent: May 4, 2004

(54) COMPOSITE DIELECTRIC FILTER DEVICE AND COMMUNICATION APPARATUS INCORPORATING THE SAME

(75) Inventors: Takahiro Okada, Nomi-gun (JP); Jinsei Ishihara, Kanazawa (JP); Hideyuki Kato, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/001,621

(22) Filed: Oct. 31, 2001

(65) Prior Publication Data

US 2002/0050874 A1 May 2, 2002

(30) Foreign Application Priority Data

Nov. 2, 1920 (JP) ..... 2000-335715
Aug. 31, 2001 (JP) ..... 2001-263835

(51) Int. Cl.[7] ..... H01P 5/12; H01P 1/213
(52) U.S. Cl. ..... 333/134; 333/206; 333/207
(58) Field of Search ..... 333/134, 202, 333/206, 207

(56) References Cited

U.S. PATENT DOCUMENTS 4,506,241 A * 3/1985 Makimoto et al. ..... 333/222
5,218,329 A * 6/1993 Vangala et al. ..... 333/206
5,365,209 A * 11/1994 Ito et al. ..... 333/206
5,929,721 A * 7/1999 Munn et al. ..... 333/134
5,959,511 A * 9/1999 Pasco et al. ..... 333/206
5,986,521 A * 11/1999 Tada et al. ..... 333/134
6,052,040 A * 4/2000 Hino ..... 333/134
6,137,382 A * 10/2000 Toda et al. ..... 333/206
6,177,852 B1 * 1/2001 Tada et al. ..... 333/202
6,351,195 B1 * 2/2002 Atokawa et al. ..... 333/134

FOREIGN PATENT DOCUMENTS

CN 1287392 A 3/2001
EP 0926759 A1 * 6/1999
EP 0997973 A1 * 5/2000
JP 200024420 A * 9/2000

OTHER PUBLICATIONS

Copy of The People's Republic of China Office Action dated Jun. 13, 2003 (and English translation of same).

* cited by examiner

*Primary Examiner*—Benny Lee
*Assistant Examiner*—Kimberly Glenn
(74) *Attorney, Agent, or Firm*—Dickstein, Shapiro, Morin & Oshinsky, LLP.

(57) ABSTRACT

The invention provides a composite dielectric filter device that can easily improve the isolation characteristics between mutually adjacent filters, even when using a compact dielectric block to miniaturize the entire configuration of the device. The invention also provides a communication apparatus incorporating the filter device. In the filter device, inner conductor holes are arranged inside a single dielectric block, and an outer conductor is formed on outer faces of the dielectric block. Additionally, an outer-conductor-free portion is formed at the boundary between a transmission filter and a reception filter formed by the inner conductor holes.

17 Claims, 6 Drawing Sheets

FIG. 6A
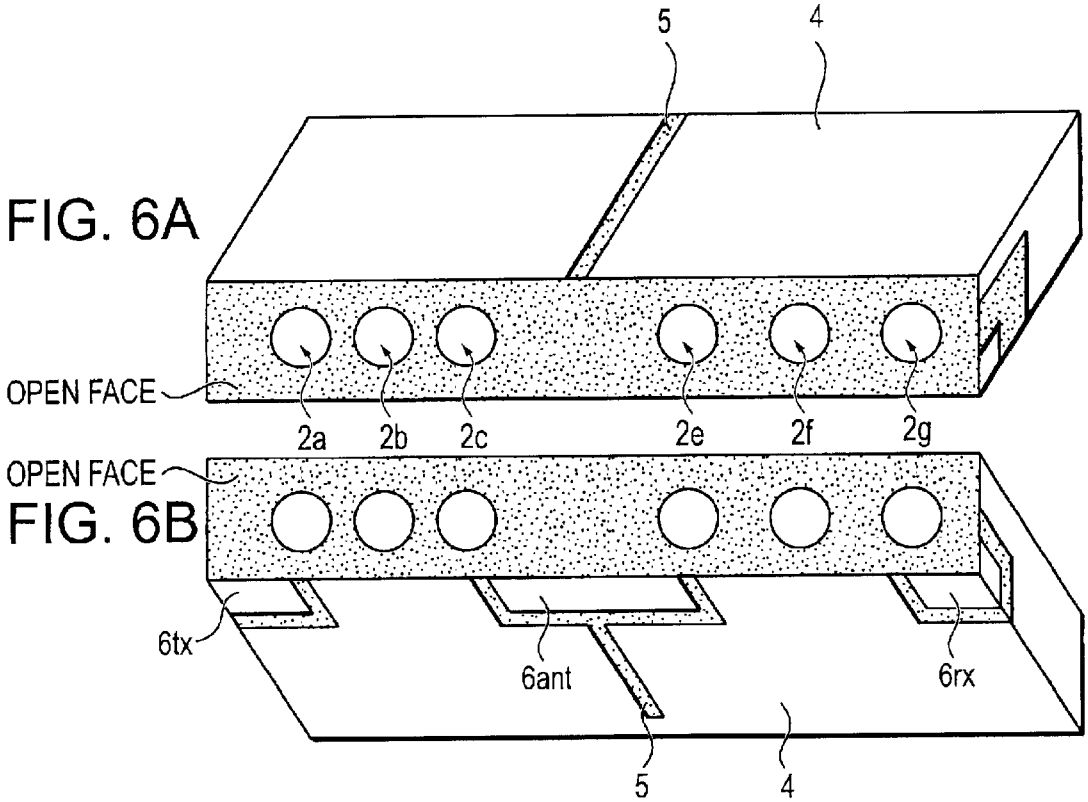
FIG. 6B
FIG. 7
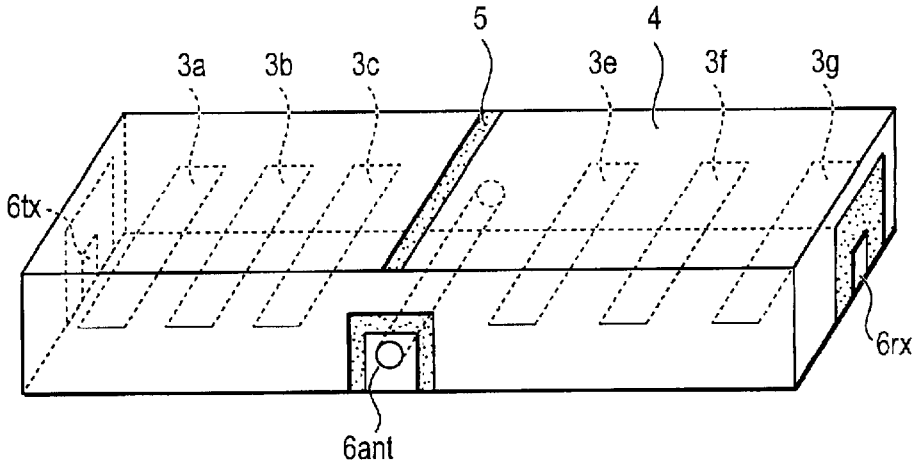

COMPOSITE DIELECTRIC FILTER DEVICE AND COMMUNICATION APPARATUS INCORPORATING THE SAME

BACKGROUND OF THE INVENTION

1. Field of the Invention

The present invention relates to composite dielectric filters formed by arranging conductive films inside and outside dielectric blocks, and communication apparatuses incorporating the composite dielectric filters.

2. Description of the Related Art

The above-mentioned filters are used as band pass filters and the like in a microwave band. Particularly, in a single dielectric block, there are provided a duplexer formed by arranging a transmission filter passing signals through a transmission frequency band and inhibiting signals from passing through a reception frequency band and a reception filter passing signals through the reception frequency band and inhibiting signals from passing through the transmission frequency band. The duplexer is used as an antenna duplexer incorporated in an apparatus such as a mobile phone.

In terms of a composite dielectric filter device using a single dielectric block including such a plurality of filters, one important point in designing the device is to secure the isolation between the filters. For example, the duplexer as the antenna duplexer is used to isolate transmission signals and reception signals. On the other hand, when the transmission signals are sent to a reception circuit, this has negative effects on the reception signals and thereby reception characteristics are deteriorated. As a result, the antenna duplexer can obtain characteristics capable of significantly attenuating transmission signals in the reception frequency band.

However, with the current trend toward the miniaturization of communication apparatuses, more compact composite dielectric filter devices have been manufactured. Consequently, there is a problem in that it is difficult to obtain isolation characteristics for measuring up to desired values.

SUMMARY OF THE INVENTION

Accordingly, it is an object of the present invention to provide a composite dielectric filter device capable of easily improving the isolation characteristics between adjacent filters even when using a compact dielectric block to miniaturize the entire configuration of the device. It is another object of the invention to provide a communication apparatus incorporating the composite dielectric filter device.

According to a first aspect of the invention, there is provided a composite dielectric filter device including a parallelepiped rectangular dielectric block, a plurality of inner conductors extending in parallel from one face of the dielectric block to the opposite face, an outer conductor arranged on at least some of the outer faces of the dielectric block so that groups of adjacent inner conductors constitutes a plurality of filters, and a outer-conductor-free portion formed at a part of the outer conductor corresponding to the boundary between the mutually adjacent filters. With this arrangement, the coupling between the ground currents of the adjacent filters, that is, the inductive coupling between the ground current of one of the filters and the ground current of the remaining filter can be suppressed. As a result, the isolation characteristics between the mutually adjacent filters can be improved.

In addition, the outer-conductor-free portion may be formed around all the outer faces of the dielectric block. With this arrangement, since the coupling between the ground currents of the filters can be suppresses without fail, the isolation characteristics between the adjacent filters can be improved.

In addition, the composite dielectric filter device may further include input/output terminals extending from one of the outer faces of the dielectric block to another face thereof. The terminals may be isolated from the outer conductor and shared by the adjacent two filters and the outer-conductor-free portion. The outer-conductor-free portion may be continuous with the periphery of the terminal. With the outer-conductor-free portion continuous with the periphery of the input/output terminal, the effect of suppressing the coupling between the ground currents of the adjacent filters can be enhanced.

Furthermore, the composite dielectric filter device may further include ground-connected metal covers connected to the outer conductors of the dielectric block. The metal cover may be arranged independently for each of the outer conductors formed by separating at the outer-conductor-free portion. With the ground-connected metal cover independently arranged for each filter, the coupling between the ground currents of the adjacent filters can be suppressed.

According to a second aspect of the invention, there is provided a communication apparatus incorporating the composite dielectric filter of the invention. The filter is used as an antenna duplexer. This arrangement can sufficiently prevent a transmission signal from being input to a reception circuit and therefore satisfactory reception characteristics can be obtained.

BRIEF DESCRIPTION OF THE DRAWINGS

FIGS. 6A and 6B show perspective views from above and below of a duplexer according to a fourth embodiment of the present invention.

FIG. 7 is a perspective view of a duplexer according to a fifth embodiment of the present invention.

DESCRIPTION OF THE PREFERRED EMBODIMENTS

Referring to FIGS. 1A to 1D, FIG. 2, and FIG. 3, a description will be given of the structure of a duplexer according to a first embodiment of the present invention.

Figure 1A:
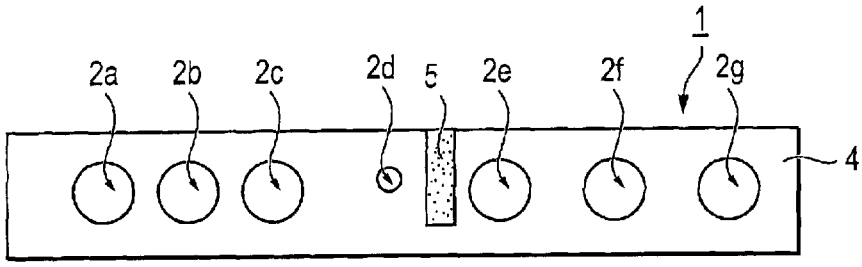
FIGS. 1A to 1D illustrate the projections of a duplexer according to a first embodiment of the present invention.
Figure 1B:
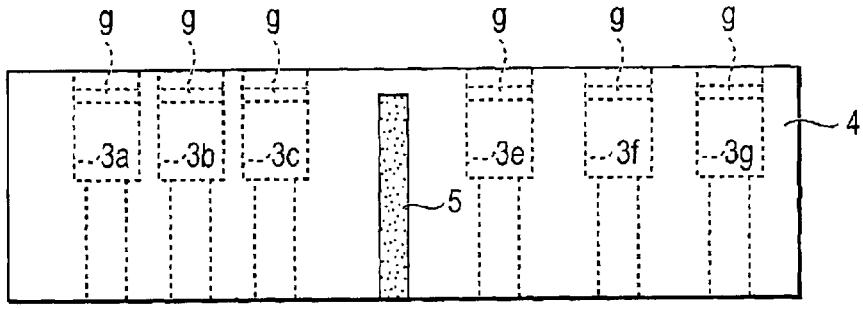
Figure 1C:
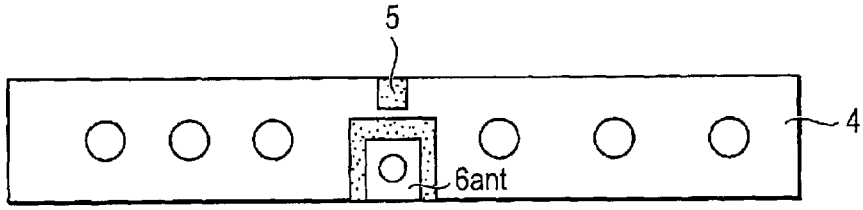
Figure 1D:
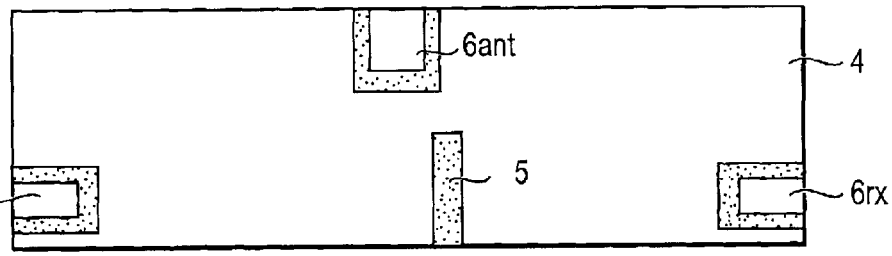

FIGS. 1A to 1D illustrate the projections of respective faces of the duplexer. FIG. 1A shows a face of the duplexer, where the open-circuited-ends of inner conductors are formed. FIG. 1B shows a top view of the duplexer when mounted on a substrate. FIG. 1C shows a face of the duplexer, where the short-circuited ends of the inner conductors are formed. FIG. 1D shows a face of the duplexer to be mounted on a substrate. As shown in these figures, a substantially parallelepiped rectangular dielectric block 1 includes seven inner conductor holes 2*a* to 2*g* arranged in parallel extending from one face thereof to a face opposed to the face. On each of the inner surfaces of the holes 2*a* to 2*g*, an inner conductor 3 is formed. In each of the inner conductor holes 2*a* to 2*c* and the inner conductor holes 2*e* to 2*g*, the inner diameter of the hole on one open-face side is large and the inner diameter of the hole on the other open-face side is small to make the hole as a stepped hole. Near each of the open-faces having the large inner diameters, an inner conductor-free portion g is formed. The inner conductor-free portion g is used as an open-circuited end of each inner conductor.

An outer conductor 4 is formed on the six outer faces of the dielectric block 1. One end of the inner conductor formed on the inner surface of each of the inner conductor holes 2*a* to 2*c* and 2*e* to 2*g* is short-circuited to the outer conductor 4 on a short-circuited face shown in FIG. 1C. On outer surfaces of the dielectric block 1, there are formed input/output terminals 6*ant*, 6*tx*, and 6*rx* isolated from the outer conductor 4.

The inner conductor hole 2*d* is a straight hole having a constant inner diameter. An inner conductor is formed on the inner surface of the hole 2*d*. The hole 2*d* is conducted to the outer conductor 4 on the face of the open-circuited end side shown in FIG. 1A. The other end of the hole 2*d* is conducted to the input/output terminal 6*ant*.

In addition, on the outer faces of the dielectric block 1, an outer-conductor-free portion 5 is formed at the boundary between a transmission filter formed by three resonators composed of the inner conductor holes 2*a* to 2*c* and a reception filter formed by three resonators composed of the inner conductor holes 2*e* to 2*g*. In the embodiment shown in FIGS. 1A to 1D, from the face on the short-circuited-end side shown in FIG. 1C to the top face of FIG. 1B, and from the face on the open-circuited end side shown in FIG. 1A to the mounted face shown in FIG. 1D, the outer-conductor-free portion 5 is independently formed. The outer-conductor-free portion 5 can suppress the coupling between the ground currents of the mutually adjacent transmission and reception filters.

Figure 2:
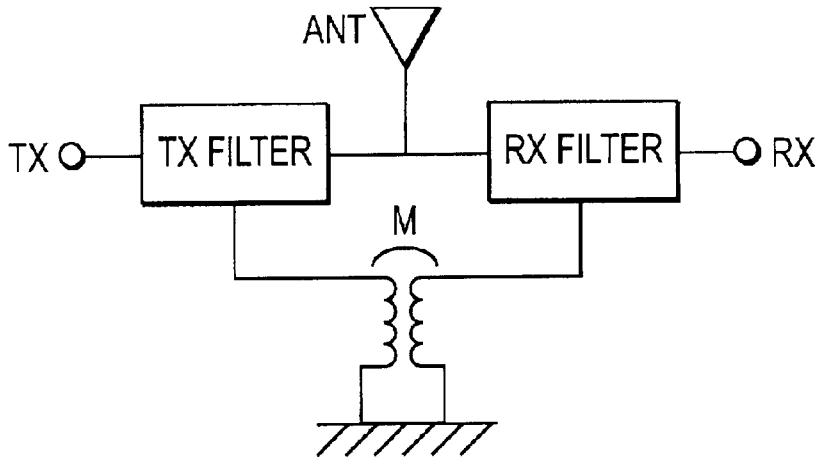
FIG. 2 is an equivalent circuit diagram shown with consideration to the coupling of ground currents in the duplexer.

FIG. 2 shows an equivalent circuit diagram of the duplexer. In FIG. 2, a TX filter is a transmission filter and a RX filter is a reception filter. The equivalent circuit shows that the ground currents of these filters are coupled by a mutual inductance M. With the outer-conductor-free portion 5 formed at the part of the outer conductor corresponding to the boundary between the adjacent filters, the mutual inductance M can be reduced and thereby the isolation between the transmission filter and the reception filter can be increased.

Figure 3:
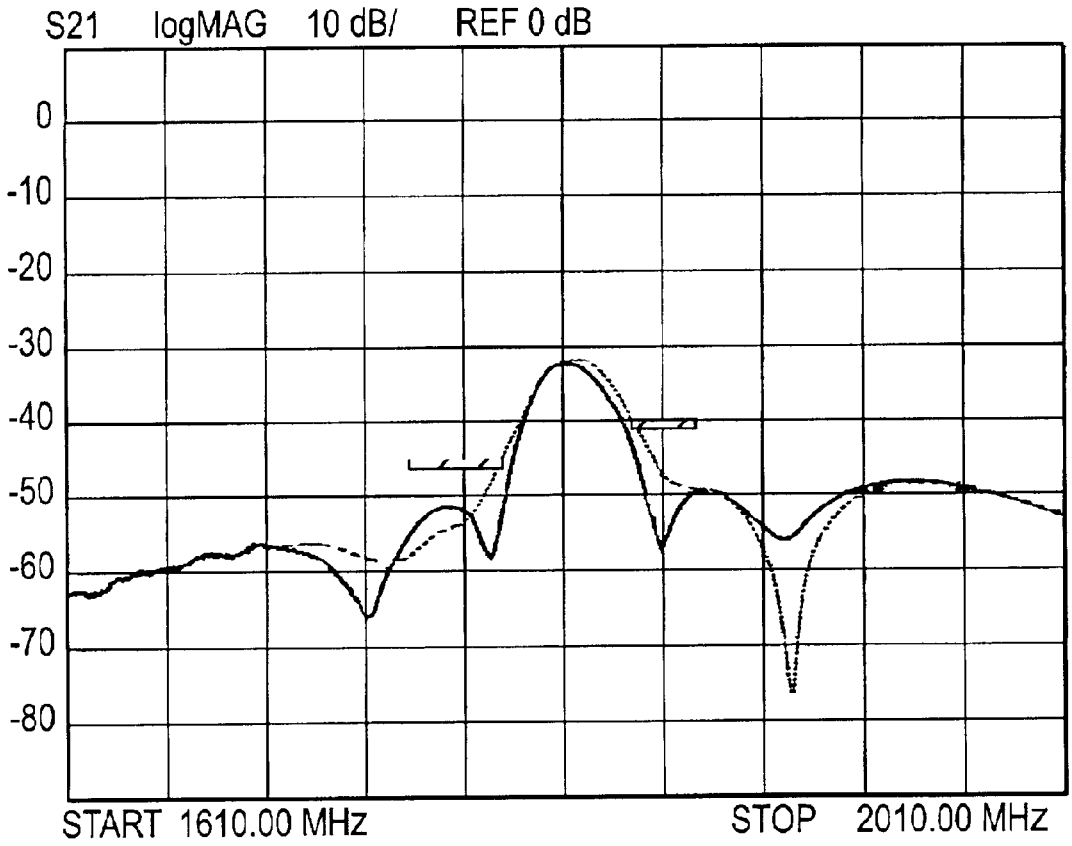
FIG. 3 is a graph showing changes in isolation characteristics depending on the presence and absence of an outer-conductor-free portion in the duplexer.

FIG. 3 shows how the isolation characteristics change depending on the presence or absence of the outer-conductor-free portion. In this graph, the lateral axis indicates frequencies and the vertical axis indicates the amount of transmission from a transmission-signal input terminal to a reception-signal output terminal. The broken line shows characteristics obtained when the outer-conductor-free portion 5 is not formed, and the solid line shows characteristics obtained when the outer-conductor-free portion 5 is formed. The boundary between a transmission frequency band and a reception frequency band is present at 1810 MHz. Hatched parts shown in the graph indicate attenuation necessary for the transmission filter at the reception frequency band and attenuation necessary for the reception filter at the transmission frequency band.

Thus, the formation of the outer-conductor-free portions permits the necessary characteristics to be obtained.

Figure 4A:
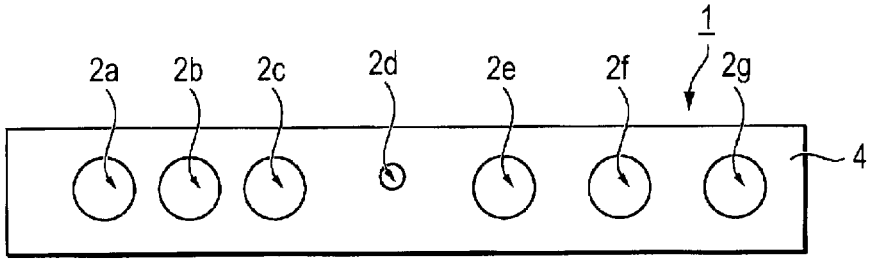
FIGS. 4A to 4D illustrate the projections of a duplexer according to a second embodiment of the present invention.
Figure 4B:
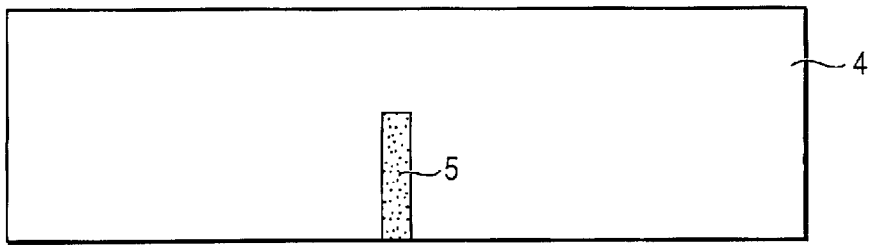
Figure 4C:
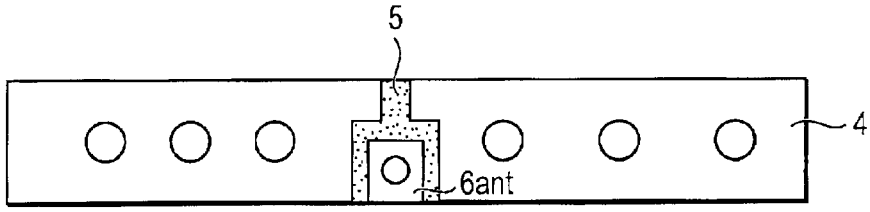
Figure 4D:
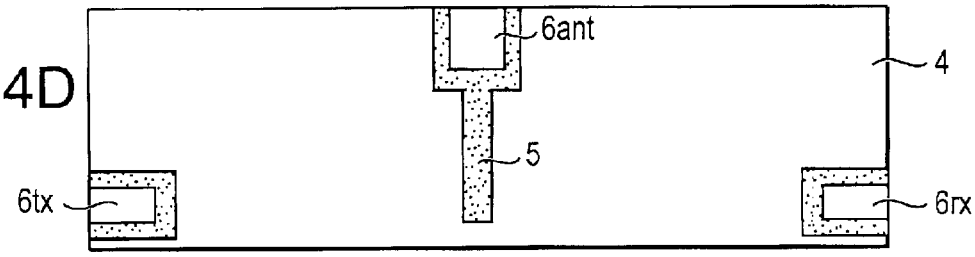

Next, referring to FIGS. 4A to 4D, a description will be given of the structure of a duplexer according to a second embodiment of the present invention. FIGS. 4A to 4D correspond to FIGS. 1A to 1D used in the first embodiment. FIG. 4A shows the face of the duplexer where the open-circuited ends of inner conductors are disposed. FIG. 4B shows a top view of the duplexer mounted on a substrate. FIG. 4C shows the face of the duplexer where the short-circuited ends of the inner conductors are disposed. FIG. 4D shows the face of the duplexer to be mounted on the substrate. In the embodiment shown in FIGS. 4A to 4D, an outer-conductor-free portion 5 is formed from the short-circuited-end face shown in FIG. 4C to the top face and to the mounted face. The outer-conductor-free portion 5 is continuous with the periphery of an input/output terminal 6*ant*, that is, with a part isolated from an outer conductor 4. The other arrangements are the same as those shown in FIGS. 1A to 1D. As a result, since the continuous length of the outer-conductor-free portion 5 can be increased, the coupling between the ground currents of the transmission and reception filters can be effectively suppressed.

Figure 5A:
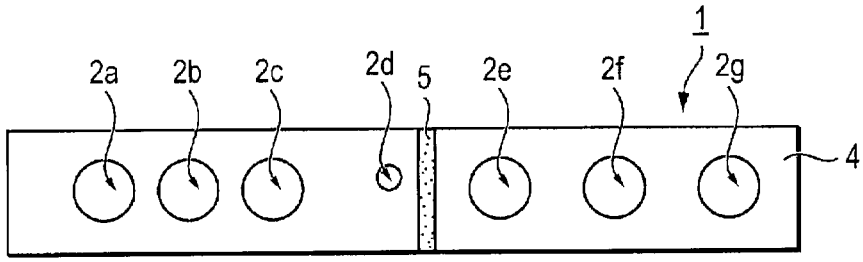
FIGS. 5A to 5D illustrate the projections of a duplexer according to a third embodiment of the present invention.
Figure 5B:
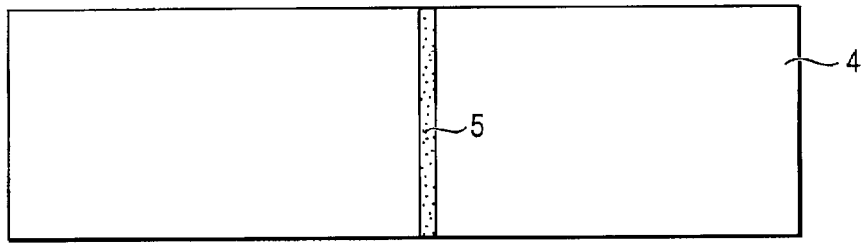
Figure 5C:
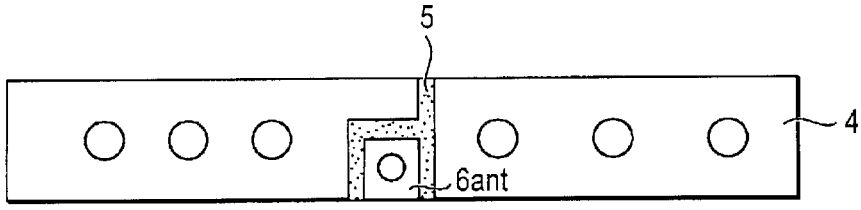
Figure 5D:
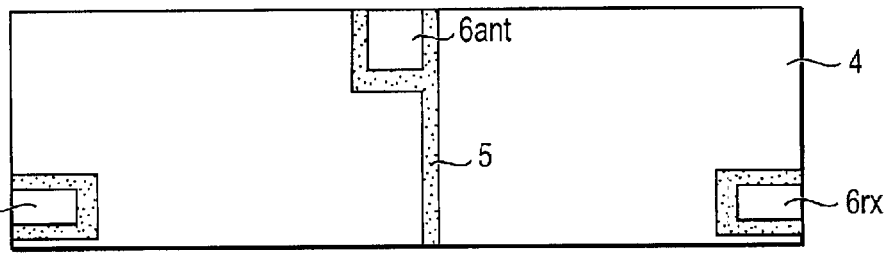

Next, referring to FIGS. 5A to 5D, a description will be given of the structure of a duplexer according to a third embodiment of the invention. FIGS. 5A to 5D correspond to FIGS. 1A to 1D shown in the first embodiment. FIG. 5A shows the face of the duplexer on which inner conductors are open-circuited. FIG. 5B shows a top view of the duplexer mounted on a substrate. FIG. 5C shows the face thereof on which the inner conductors are short-circuited. FIG. 5D shows the face of the duplexer to be mounted on the substrate. In the embodiment shown in FIGS. 5A to 5D, an outer-conductor-free portion 5 is disposed in a manner continuous with a part isolated from an outer conductor 4, that is, with the periphery of an input/output terminal 6*ant*, while continuously going around all the outer faces of a dielectric block 1, like a belt. The other arrangements in this embodiment are the same as those shown in FIGS. 1A to 1D. In this manner, the coupling between the ground currents of a transmission filter and a reception filter can be more sufficiently suppressed, thereby improving the isolation characteristics between the filters.

Next, referring to FIGS. 6A and 6B, a description will be given of the structure of a duplexer according to a fourth embodiment of the invention. FIG. 6A shows a perspective view of the dielectric duplexer seen from above. FIG. 6B shows a perspective view thereof seen from below. In each of the first to third embodiments, the inner conductor for excitation is disposed between a transmission filter and a reception filter, inside the dielectric block. Then, the excitation inner conductor is coupled with the final-stage resonator of the transmission filter and the initial-stage resonator of the reception filter. However, in the fourth embodiment shown in FIGS. 6A and 6B, with a transmission filter formed by three resonators composed of inner conductor holes 2*a* to 2*c* and a reception filter formed by three resonators composed of inner conductor holes 2*e* to 2*g*, there is provided an input/output terminal 6*ant* which is capacitively coupled with the inner conductor of the inner conductor hole 2*c* as the first-stage resonator of the transmission filter and is also coupled with the inner conductor of the inner conductor hole 2*e* as the initial-stage resonator of the reception filter. An input/output terminal 6*tx* is capacitively coupled with the inner conductor of the inner conductor hole 2*a* and an input/output terminal 6*rx* is capacitively coupled with the inner conductor of the inner conductor hole 2*g*. In the duplexer having such an arrangement, an outer-conductor-free portion 5 is disposed at the boundary between the transmission filter and the reception filter on some of the outer faces of a dielectric block. In this embodiment, on the top face of the dielectric block, the outer-conductor-free portion 5 is disposed in a manner continuous with the open-circuited-end face of the inner conductors, and also, on the mounting face of the dielectric block, the outer-conductor-free portion 5 is disposed in a manner continuous with a part of the input/output terminal 6*ant* isolated from an outer conductor 4.

Next, referring to FIG. 7, a description will be given of the structure of a duplexer according to a fifth embodiment of the invention. In each of the first to fourth embodiments, the inner conductor holes having round sections are disposed and the inner conductors are formed on the inner surfaces of the holes. However, in the fifth embodiment shown in FIG. 7, inside a dielectric block, planer inner conductors 3*a* to 3*c* and 3*e* to 3*g* are formed to constitute stripline resonators. In this arrangement, similar to the previous embodiments, when an outer-conductor-free portion 5 is disposed at the boundary between a transmission filter and a reception filter on the outer faces of the dielectric block, the coupling between the ground currents of the filters can be suppressed, thereby increasing the isolation between the filters.

Next, referring to FIG. 8, a description will be given of the structure of a duplexer according to a sixth embodiment of the invention.

Figure 8:
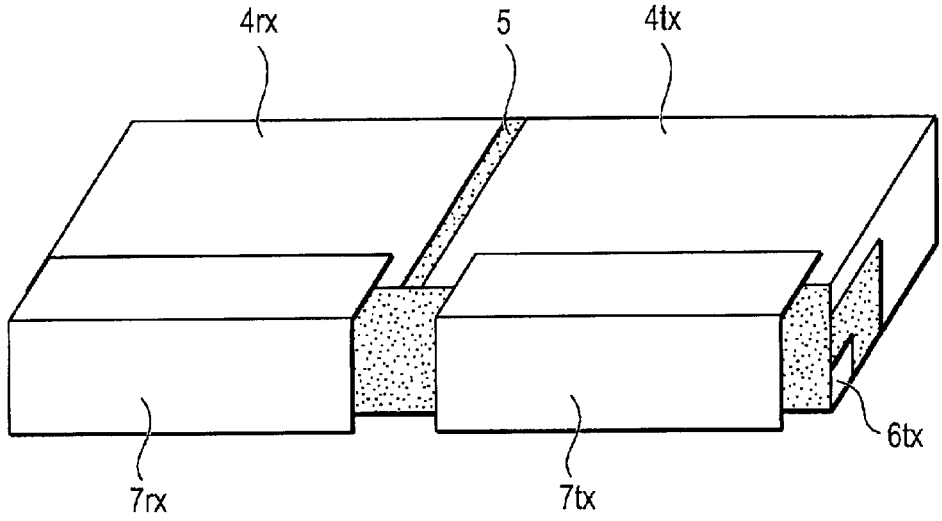
FIG. 8 is a perspective view of a duplexer according to a sixth embodiment of the present invention.

FIG. 8 shows a perspective view of the duplexer mounted on a substrate. In this figure, reference numerals 7*rx* and 7*tx* denote metal covers covering the open face of a dielectric block and electrically connecting outer conductors 4*rx* and 4*tx* formed on the outer surface of the dielectric block to a ground electrode on the mounted substrate. The conductor 4*rx* denotes the outer conductor of a reception filter side and the conductor 4*tx* denotes the outer conductor of a transmission filter side. The structure of the dielectric block is the same as the structure shown in FIGS. 6A and 6B.

In this manner, the outer conductors 4*rx* and 4*tx* formed by separating at the outer-conductor-free portion 5 are grounded via the mutually independent metal covers 7*rx* and 7*tx*. Due to ground currents flowing through the metal covers 7*rx* and 7*tx*, the coupling between the ground currents of the transmission filter and the reception filter can be suppressed, thereby increasing the isolation between the filters.

Next, referring to FIG. 9, a description will be given of a communication apparatus according to a seventh embodiment of the invention.

Figure 9:
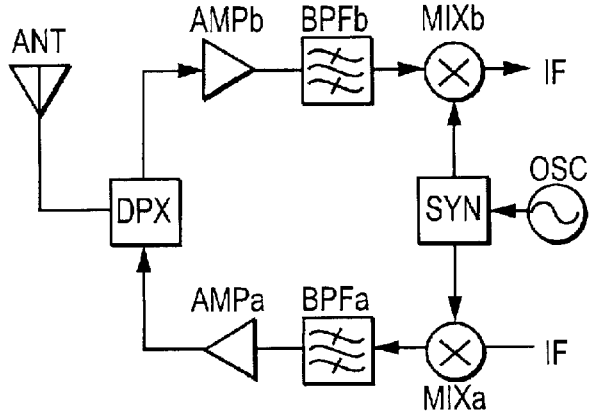
FIG. 9 is a block diagram of a communication apparatus according to a seventh embodiment of the present invention.

In FIG. 9, there are shown a transmission/reception antenna ANT, a duplexer DPX, band pass filters BPFa and BPFb, amplifiying circuits AMPa and AMPb, mixers MIXa and MIXb, an oscillator OSC, and a frequency synthesizer SYN.

The mixer MIXa mixes an IF signal of a transmission signal with a signal output from the SYN. Of the mixed signals output from the mixer MIXa, the band pass filter BPFa passes only the signals of a transmission frequency band. The amplifier circuit AMPa power-amplifies the signals to transmit from the antenna ANT via the duplexer DPX. The amplifier circuit AMPb amplifies a reception signal extracted from the duplexer DPX. Of the reception signals output from the amplifier circuit AMPb, the band pass filter BPFb passes only the signals of a reception frequency band. The MIXb mixes a frequency signal output from the SYN with the reception signal to output an intermediate frequency signal IF of the reception signal.

The above duplexer DPX is the duplexer having the structure shown in one of FIGS. 1A to 1D and FIG. 4A to FIG. 8.

In each of the above embodiments, in order to couple the resonators composed of the inner conductors disposed inside the dielectric block, the inner conductor holes have the stepped configuration and the open-circuited ends of the holes have top-end capacitances formed of inner conductor-free portions. Besides, there are other applicable methods. For example, on the open face of a dielectric block, electrodes for coupling resonators are formed extending from inner conductors to the openings of adjacent inner conductors so that the coupling between the mutually adjacent resonators can be made. Alternatively, holes, cavities, or slits used for coupling are formed between the adjacent inner conductor holes to couple the adjacent resonators. Any of these methods can be similarly applied to the present invention.

As described above, the outer-conductor-free portion is formed at a part of the outer conductor corresponding to the boundary between adjacent filters. With this arrangement, the coupling between the ground currents of mutually adjacent filters can be suppressed and thereby the isolation characteristics between the adjacent filters can be improved.

In addition, the outer-conductor-free portion is formed around all the outer faces of the dielectric block. This arrangement can suppress the coupling between the ground currents of the filters without fail and thereby the isolation characteristics between the mutually adjacent filters can be improved.

In addition, the outer-conductor-free portion formed on the outer face of the dielectric block is arranged continuously with the periphery of the input/output terminal shared by the mutually adjacent two filters. Thus, since the outer-conductor-free portion is continuously extended to the periphery of the input/output terminal, the coupling between the ground currents of the mutually adjacent filters can be effectively suppressed.

In addition, ground-connected metal covers continuous with the outer conductor of the dielectric block are independently arranged for the respective outer conductors formed by separating at the outer-conductor-free portion. That is, the ground-connected metal covers are independent for the respective filters. Thus, the coupling between the ground currents of the mutually adjacent filters can be effectively suppressed.

Furthermore, according to this invention, the composite dielectric filter device having the above-described structure is incorporated in an antenna duplexer or the like to constitute a communication apparatus. As a result, since the arrangement can prevent a transmission signal from being sent to a reception circuit, satisfactory reception characteristics can be obtained.

While embodiments of the present invention have been described above, variations thereto will occur to those skilled in the art within the scope of the present inventive concepts, which are delineated by the following claims.

What is claimed is:

1. A composite dielectric filter device comprising:

a dielectric block;

a plurality of inner conductors extending in parallel from a first face of the dielectric block to a second face opposite the first face;

an outer conductor arranged on at least some outer faces of the dielectric block so that groups of adjacent inner conductors among the plurality of inner conductors form at least two mutually adjacent filters;

an outer-conductor-free portion formed at a part of the outer conductor corresponding to a boundary between the at least two mutually adjacent filters; and an input/output terminal shared by the at least two mutually adjacent filters, wherein at least a part of the input/output terminal is provided on the first face of the dielectric block and is isolated from the outer conductor, and each of the inner conductors of the groups of adjacent inner conductors are directly connected to each other by the outer conductor along the first face of the dielectric block.

2. The composite dielectric filter device according to claim 1, further comprising ground-connectable metal covers connected to the outer conductor of the dielectric block, the metal covers being arranged independently for respective parts of the outer conductor separated by the outer-conductor-free portion.

3. The composite dielectric filter device according to claim 1, wherein at least one of the plurality of inner conductors is a stepped hole having different diameters at the first face and the second face.

4. The composite dielectric filter device according to claim 3, wherein the diameter of the at least one stepped hole at the first face is smaller than the diameter at the second face.

5. The composite dielectric filter device according to claim 1, wherein the plurality of inner conductors are planar inner conductors.

6. The composite dielectric filter device according to claim 1, further comprising a conductor hole formed in the dielectric block and extending from the first face to the second face of the dielectric block, the conductor hole being conducted to the part of the input/output terminal on the first face of the dielectric block.

7. A communication apparatus comprising the composite dielectric filter device according to claim 1, wherein:

the composite dielectric filter device forms an antenna duplexer, the at least two mutually adjacent filters comprise a transmitting filter and a receiving filter having a transmitting terminal and a receiving terminal, respectively, the input/output terminal is an antenna terminal for the duplexer, and a high-frequency circuit is connected to at least one of the transmitting terminal and the receiving terminal.

8. The composite dielectric filter device according to claim 1, wherein the outer-conductor-free portion is formed on an outer surface of the dielectric block.

9. The composite dielectric filter device according to claim 1, wherein the outer-conductor-free portion is positioned so as to suppress a coupling between the at least two mutually adjacent filters.

10. A composite dielectric filter device comprising:

a dielectric block;

a plurality of inner conductors extending in parallel from a first face of the dielectric block to a second face opposite the first face;

an outer conductor arranged on at least some outer faces of the dielectric block so that groups of adjacent inner conductors among the plurality of inner conductors form at least two mutually adjacent filters;

an outer-conductor-free portion formed at a part of the outer conductor corresponding to a boundary between the at least two mutually adjacent filters; and an input/output terminal shared by the at least two mutually adjacent filters, wherein at least a part of the input/output terminal is provided on the first face of the dielectric block and is isolated from the outer conductor, each of the inner conductors of the groups of adjacent inner conductors are directly connected to each other by the outer conductor along the first face of the dielectric block, and wherein the outer-conductor-free portion is formed continuously around outer faces of the dielectric block.

11. A composite dielectric filter device comprising:

a dielectric block;

a plurality of inner conductors extending in parallel from a first face of the dielectric block to a second face opposite the first face;

an outer conductor arranged on at least some outer faces of the dielectric block so that groups of adjacent inner conductors among the plurality of inner conductors form at least two mutually adjacent filters;

an outer-conductor-free portion formed at a part of the outer conductor corresponding to a boundary between the at least two mutually adjacent filters; and an input/output terminal shared by the at least two mutually adjacent filters, wherein at least a part of the input/output terminal is provided on the first face of the dielectric block and is isolated from the outer conductor, each of the inner conductors of the groups of adjacent inner conductors are directly connected to each other by the outer conductor along the first face of the dielectric block, and wherein the outer-conductor-free portion is arranged continuously with a periphery of the input/output terminal.

12. A composite dielectric filter device comprising:

a dielectric block;

a plurality of inner conductors extending in parallel from a first face of the dielectric block to a second face opposite the first face;

an outer conductor arranged on at least some outer faces of the dielectric block so that groups of adjacent inner conductors among the plurality of inner conductors form at least two mutually adjacent filters;

an outer-conductor-free portion formed at a part of the outer conductor corresponding to a boundary between the at least two mutually adjacent filters; and an input/output terminal shared by the at least two mutually adjacent filters, wherein at least a part of the input/output terminal is provided on a third face of the dielectric block which is parallel to the plurality of inner conductors and is isolated from the outer conductor, the outer-conductor-free portion is arranged continuously with a periphery of the input/output terminal and is provided on both the third face of the dielectric block and a fourth face of the dielectric block which is opposite the third face, and the first face of the dielectric block is an open-circuited face and does not include the outer conductor at a portion between the at least two mutually adjacent filters.

13. The composite dielectric filter device according to claim 12, further comprising ground-connectable metal covers connected to the outer conductor of the dielectric block, the metal covers being arranged independently for respective parts of the outer conductor separated by the outer-conductor-free portion.

14. The composite dielectric filter device according to claim 12, wherein at least one of the plurality of inner conductors is a stepped hole having different diameters at the first face and the second face.

15. The composite dielectric filter device according to claim 14, wherein the diameter of the at least one stepped hole at the first face is smaller than the diameter at the second face.

16. The composite dielectric filter device according to claim 12, wherein the plurality of inner conductors are planar inner conductors.

17. A communication apparatus comprising the composite dielectric filter device according to claim 12, wherein:

the composite dielectric filter device forms an antenna duplexer, the at least two mutually adjacent filters comprise a transmitting filter and a receiving filter having a transmitting terminal and a receiving terminal, respectively, the input/output terminal is an antenna terminal for the duplexer, and a high-frequency circuit is connected to at least one of the transmitting terminal and the receiving terminal.

* * * * *